US011717057B2

(12) United States Patent
DeCaire

(10) Patent No.: US 11,717,057 B2
(45) Date of Patent: Aug. 8, 2023

(54) MIDSOLE TRACTION DEVICE

(71) Applicant: Geroline Inc., St. Catharines (CA)

(72) Inventor: Ryan DeCaire, Toronto (CA)

(73) Assignee: Geroline Inc., St. Catharines (CA)

( * ) Notice: Subject to any disclaimer, the term of this patent is extended or adjusted under 35 U.S.C. 154(b) by 0 days.

(21) Appl. No.: 17/363,977

(22) Filed: Jun. 30, 2021

(65) Prior Publication Data

US 2021/0401125 A1 Dec. 30, 2021

Related U.S. Application Data

(60) Provisional application No. 63/046,124, filed on Jun. 30, 2020.

(51) Int. Cl.
*A43C 15/06* (2006.01)
*A43C 15/12* (2006.01)

(52) U.S. Cl.
CPC ..... *A43C 15/065* (2013.01); *A43C 15/12* (2013.01)

(58) Field of Classification Search
CPC ..... A43C 15/02; A43C 15/06; A43C 15/063; A43C 15/065; A43C 15/066; A43C 15/08; A43C 15/12
USPC ..... 36/62
See application file for complete search history.

(56) References Cited

U.S. PATENT DOCUMENTS

| | | | | |
|---|---|---|---|---|
| 36,866 | A | 11/1862 | Starr | |
| 156,094 | A | 10/1874 | Lemmon | |
| 905,510 | A | 12/1908 | Frautschi, Jr. | |
| 1,018,708 | A * | 2/1912 | Hetrick | A43C 15/063 36/62 |
| 1,032,600 | A | 7/1912 | Grout | |
| 1,275,917 | A | 8/1918 | Herman | |
| 2,006,802 | A | 7/1935 | Goodman | |
| 2,045,066 | A | 6/1936 | Bower | |
| 2,179,178 | A | 11/1939 | Helmer | |
| 2,208,200 | A | 7/1940 | Sloan | |
| 2,296,660 | A | 9/1942 | Bowman | |
| 2,313,316 | A | 3/1943 | Block | |
| 2,366,649 | A | 1/1945 | Priess | |
| 2,401,891 | A | 6/1946 | Smith | |
| 2,431,748 | A | 12/1947 | Tony | |
| 2,438,193 | A | 3/1948 | Wayne | |

(Continued)

FOREIGN PATENT DOCUMENTS

KR 20140135529 A * 11/2014

OTHER PUBLICATIONS

1 Pair 2017 New Durable Anti Slip Snow Ice Climbing Spikes, Jun. 19, 2017, [online], [site visited Aug. 26, 2017]. Retrieved from url:https://www.aliexpress.com/item/Winter-5-studs-Snow-Anti-Slip-ice-crampons-Mens-Ice-Snow-Crampons-Shoes-snow-walker-for/32802916137.html?spm=2114.search0302.4.40.1clbun.

(Continued)

*Primary Examiner* — Ted Kavanaugh
(74) *Attorney, Agent, or Firm* — Andrus Intellectual Property Law, LLP

(57) ABSTRACT

A midsole traction device is described. The midsole traction device comprises a first base portion; a second base portion and a flexible connector portion connecting the first base portion to the second base portion. The first base portion comprises a first traction aid on a first side of the midsole traction device. The second base portion comprising a second traction aid of the first side of the midsole traction device. The second traction aid is different to the first traction aid.

16 Claims, 3 Drawing Sheets

(56) References Cited

U.S. PATENT DOCUMENTS

| | | | | |
|---|---|---|---|---|
| 2,636,175 | A | 4/1953 | Hoffman | |
| 2,658,289 | A | 11/1953 | Schrieber | |
| 3,691,659 | A | 9/1972 | Nakajima | |
| 3,838,528 | A | 10/1974 | Johnson | |
| 4,005,533 | A | 2/1977 | Anderson et al. | |
| D262,157 | S | 12/1981 | Kinchen et al. | |
| 4,525,939 | A * | 7/1985 | McNeil | A43C 15/06 36/114 |
| D336,559 | S | 6/1993 | Carmichael | |
| 5,485,687 | A | 1/1996 | Rohde | |
| 5,659,978 | A * | 8/1997 | Bell | A43C 15/06 36/62 |
| 6,434,859 | B1 | 8/2002 | Kim | |
| 8,371,045 | B2 | 2/2013 | Tambay | |
| D790,172 | S | 6/2017 | Hatfield | |
| D807,005 | S | 1/2018 | Savio | |
| D831,320 | S | 10/2018 | Savio et al. | |
| D879,443 | S | 3/2020 | Fridgen | |
| 2005/0241179 | A1* | 11/2005 | Chen | A43B 7/085 36/3 R |
| 2010/0139118 | A1* | 6/2010 | Park | A43B 5/001 36/62 |
| 2011/0083344 | A1 | 4/2011 | Tambay | |
| 2013/0312294 | A1* | 11/2013 | Tang | A43C 15/12 36/59 R |
| 2017/0251765 | A1 | 9/2017 | Romeril | |

OTHER PUBLICATIONS

K1 Midsole—Industrial Commercial model of innovative, new ice Cleat, Jul. 27, 2016, [online], [site visited Sep. 7, 2017]. Retrieved from url:https://www.youtube.com/watch?v=mmnrwnQYlaw.

* cited by examiner

MIDSOLE TRACTION DEVICE

The present invention relates generally to a traction device for footwear and specifically to a midsole traction device for slippery surfaces. This application claims priority to U.S. Provisional Patent Application Ser. No. 63/046,124 filed on Jun. 30, 2020.

BACKGROUND

Footwear traction devices to improve traction for a wearer on slippery surfaces are well known to those skilled in the art. Typically, such devices have been designed to improve the wearer's traction while walking on ice and include metallic cleats or spikes for gripping the surface of the ice.

For example, U.S. Pat. Nos. 2,366,649, 2,208,200, and 2,166,958 disclose devices utilizing metallic cleats that can be attached about the instep of a shoe. However, the use of metallic cleats tends to damage hardwood floors, tile, and carpet encountered when entering or leaving a building to walk on the ice.

Still other footwear traction devices have utilized abrasive grit materials embedded in a pad or plate which is attached to the bottom of the wearer's shoe to provide friction on the ice. U.S. Pat. Nos. 4,702,021 and 5,485,687 disclose shoe attachment devices of the abrasive type that are also unsuitable for use on floors and carpets.

Accordingly, it is an objected of the present invention to obviate or mitigate at least some of the above-mentioned disadvantages.

SUMMARY OF THE INVENTION

In accordance with an aspect of an embodiment, there is provided a midsole traction device comprising: a first base portion comprising a first traction aid; a second base portion comprising a second traction aid, the second traction aid configured to be different to the first traction aid; and a flexible connector portion connecting the first base portion to the second base portion.

In an embodiment, the flexible connector portion comprises a first edge extending between the first base portion and the second base portion and a second edge extending between the first base portion and the second base portion. The first edge is shorter than the second edge, thereby creating an offset angle $\alpha$ between the first base portion and the second base portion.

Thus, it will be appreciated that the midsole traction device as described herein allows the wearer to easily switch between different traction aids to provide different levels of traction.

BRIEF DESCRIPTION OF THE DRAWINGS

The invention will be described by way of example only with reference to the following drawings in which.

DETAILED DESCRIPTION OF THE PREFERRED EMBODIMENTS

Figure 1:
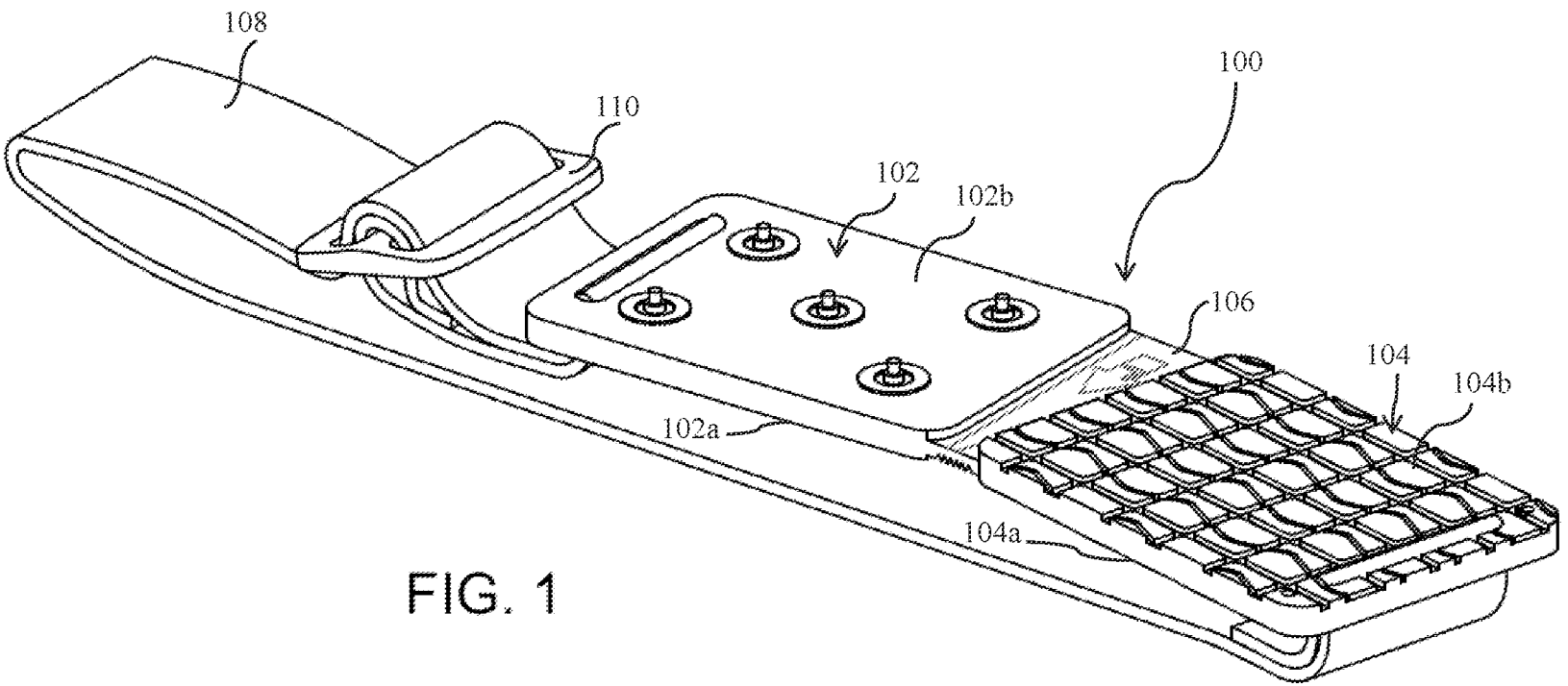
FIG. 1 is an isometric view of a midsole traction device in accordance with an aspect of an embodiment coupled to a strap.
Figure 2A:
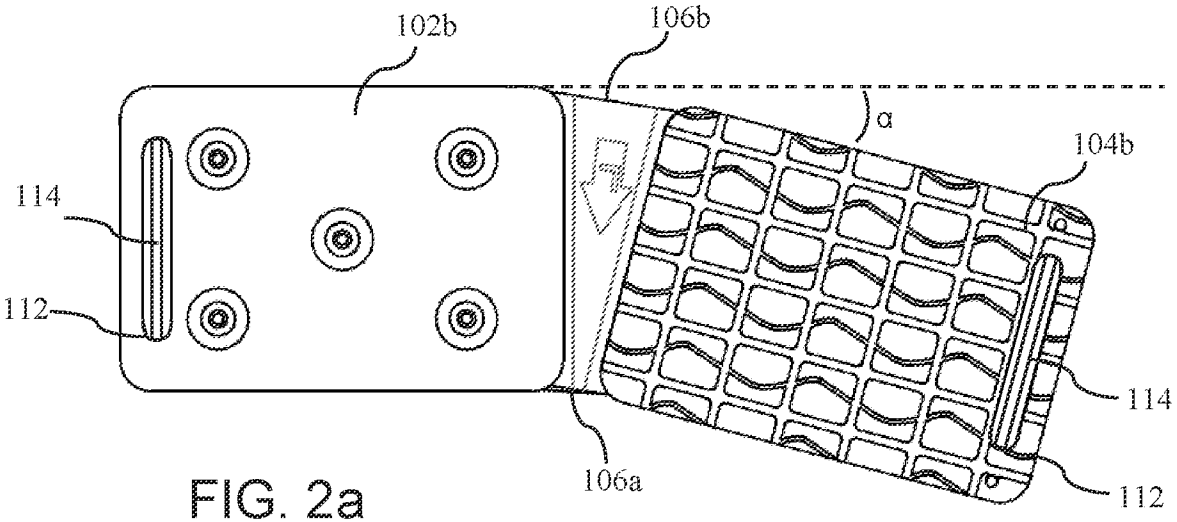
FIG. 2*a* is a bottom view of the midsole traction device.
Figure 2B:
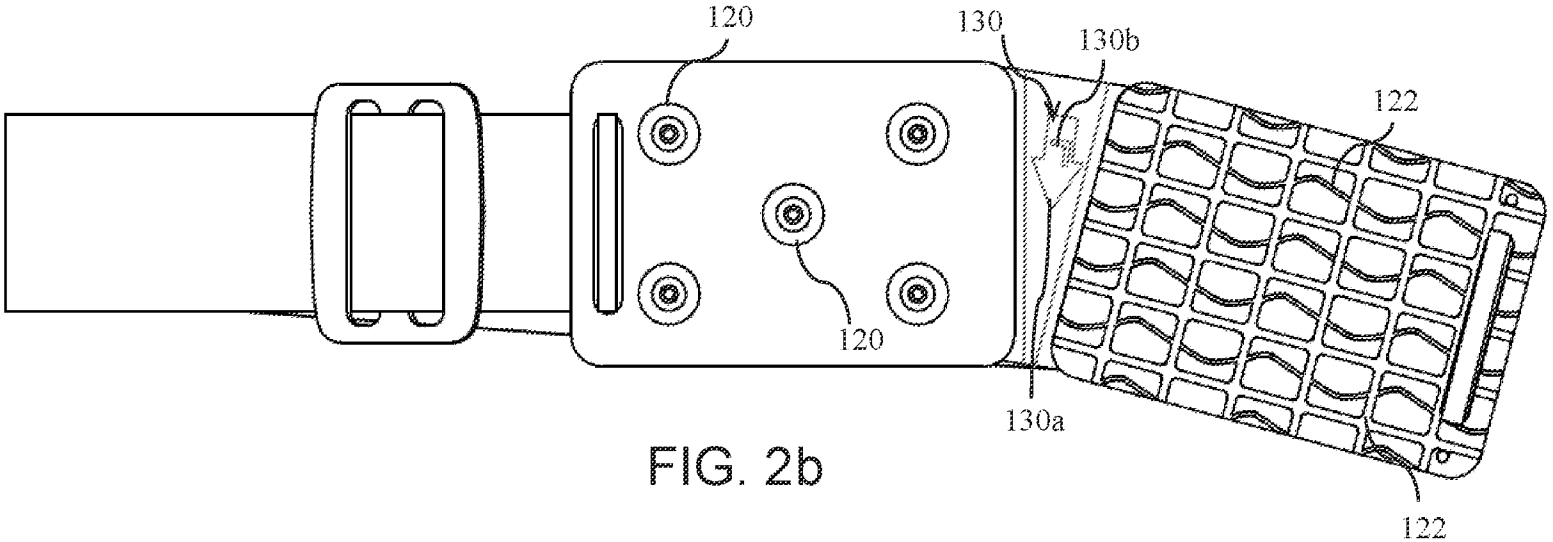
FIG. 2*b* is a bottom view of the midsole traction device coupled to the strap.
Figure 3:
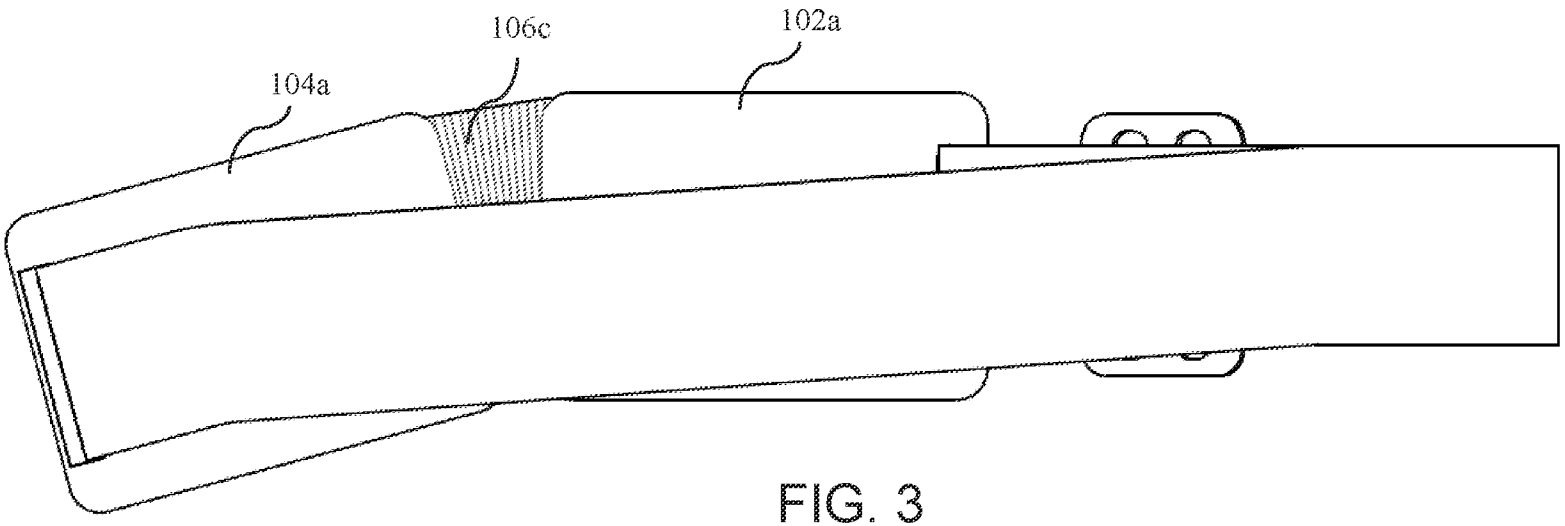
FIG. 3 is a top view of the midsole traction device coupled to the strap.

For convenience, like numerals in the description refer to like structures in the drawings. Referring to FIGS. 1 to 3, a midsole traction device is illustrated generally by numeral 100. The midsole traction device 100 comprises a first base portion 102, a second base portion 104, and a flexible connector portion 106. The midsole traction device 100 is coupled to a strap 108. The strap 104 includes a slide buckle 110. The flexible connector portion 106 includes a visual indicator 130. FIGS. 1 to 3 illustrate the configuration of the midsole traction device 100 for use with a left shoe. As will be appreciated by a person of ordinary skill in the art, the configuration of the midsole traction device 100 for use with a right shoe is a mirror image of the midsole traction device 100 for use with the left shoe Each of the first base portion 102 and the second base portion 104 includes a slot 112 at a distal end thereof. Each of the slots 112 is directed along the width of the corresponding first base portion 102 and the corresponding second base portion 104. Each slot 112 includes a rod 114 extending across a length thereof. The strap 108 is wrapped around the rod and secured in place, thereby coupling it to the midsole traction device 100. The strap 108 is configured to slide through the slide buckle 110 to adjust its length, as is known in the art.

Both the first base portion 102 and the second base portion 104 are sized and shaped to fit mid-sole of the shoe, adjacent its heel. Inserts may be provided to increase the thickness of the first base portion 102 and the second base portion 104 if desired by the wearer, as is known in the art.

The first base portion 102 comprises a first top side 102*a* and a first bottom side 102*b*. Similarly, the second base portion 104 comprises a second top side 104*a* and a second bottom side 104*b*. The relative terms "top" and "bottom" are defined with reference to the midsole traction device 100 in use. For example, the top side references a side that is configured to be positioned adjacent the shoe when in use. The bottom side references a side that is configured to be positioned adjacent the ground when in use. In an embodiment, the first top side 102*a* and the second top side are substantially flat.

The first bottom side 102*b* comprises a first traction aid 120. The first traction aid 120 is configured to improve traction for the wearer on a first surface. The second bottom side 104*b* comprises a second traction aid 122. The second traction aid 122 is different to the first traction aid 120. The second traction aid 122 is configured to improve traction for the wearer on a second surface.

The first traction aid 120 may comprise, for example, a plurality of cleats or spikes. The cleats 120 are shaped and sized to pierce a surface such as snow or ice and improve the traction for the wearer. In the embodiment illustrated, the cleats 120 are arranged in an "X" configuration. As will be appreciated by a person skilled in the art, various shaped and sized cleats 120 may be used depending on the surface for which the midsole traction device 100 is designed. Similarly, various numbers and configurations of the cleats 120 may also be used.

The second traction aid 122 may comprise, for example, a plurality of grooves and channels in the surface of the second bottom side 102*b*. The grooves and channels 122 are shaped and sized to allow water to flow there through, thereby improving traction for the wearer on a wet surface without the use of cleats. Such a traction aid may be useful, for example, on surfaces that may be damaged by the cleats or surface that are too strong for the cleats to pierce. As will be appreciated by a person skilled in the art, various shaped and sized grooves and channels 122 may be used. Similarly, various patterns and configurations of the grooves and channels 122 may also be used.

The flexible connector portion 106 has a first edge 106*a* extending between the first base portion 102 and the second base portion 104 and second edge 106*b* extending between the first base portion 102 and the second base portion 104. The first edge 106*a* is shorter than the second edge 106*b*, thereby creating an offset angle α between the first base portion 102 and the second base portion 104. In an embodiment, an example of the offset angle α is approximately 15 degrees. In an embodiment, the longer second edge 106*b* is to be positioned proximal to the heel. The shorter first edge 106*a* is to be positioned distal to heel. Further, in an embodiment, a top side 106*c* of the flexible connector portion 106 is corrugated. It is expected that the corrugation will improve the durability of the flexible connector portion 106 in cold weather conditions.

The visual indicator 130 provides the wearer with an indication of the proper positioning of the midsole traction device 100. In an example, the visual indicator 130 includes an arrow 130*a* and a letter 130*b*. The letter 130*b* identifies whether the midsole traction device is for a left (L) shoe or for a right (R) shoe. The arrow 130*a* is pointed towards the shorter first edge 106*a* of the flexible connector 106. Thus, for example, if the wearer places the midsole traction device 100 on a left or right shoe as indicated by the letter 130*b* with the arrow 130*a* directed towards the toe of the shoe, then the midsole traction device 100 will be properly aligned with the shoe.

Although the midsole traction device 100 is described above with respect to a particular embodiment, other embodiments will be apparent to those skilled in the art in view of this disclosure. For example, the strap 108 can be coupled to the midsole traction device 100 without the use of the rod 114. Instead, the strap 108 can pass through the slot 112 and wrap around an edge of the base adjacent the slot. As another example, a connector portion can be molded to the outer opposing edges of the midsole traction device 100, and the strap 108 could be coupled to the connector portion. Yet further, the slide buckle 110 is only one example of a buckle type that could be used. Other types of buckles include conventional buckles, side release buckles, ratchet buckle, and the like. Additionally, rather than a buckle, other types of connectors, such as Velcro® can be used.

As described above, the first traction aid 120 and the second traction aid 122 are provided for different surfaces. However, in an alternative embodiment, the first traction aid 120 and the second traction aid 122 may provide different levels of traction for the same surface. That is, for example, the second traction aid 122 may also be configured with cleats, rather than the grooves and channels illustrated in FIGS. 1 to 3. However, the cleats forming the second traction aid 122 could be shorter or longer than the cleats forming the first traction aid 120, thereby providing the wearer with different levels of traction for ice and snow. The cleats in the second traction aid 122 could also be configured in a different configuration and/or with a different number of cleats, further distinguishing its capability from the capability of the first traction aid 120.

Yet further, although the flexible connector portion 106 is corrugated on its top portion 106*c*, it may be corrugated on its bottom portion, on both top and bottom portions, or not at all. Although, these embodiments may not provide the same durability, they may provide sufficient durability for some implementations of the midsole traction device 100.

These and other variations upon the embodiments are intended to be covered by the present disclosure, which is limited only by the appended claims.

In an example as described above, the midsole traction device 100 includes the first base portion 102 with a first side 102*a* which faces the footwear midsole and a second side 102*b* opposite the first side and which faces away from the footwear midsole and includes the first traction aid 120. The first base portion 102 further includes a first interior edge, the first base portion extending away from the first interior edge. The midsole traction device 100 further includes the second base portion 104 with a first side 104*a* which faces the footwear midsole and a second side 104*b* opposite the first side and which faces away from the footwear midsole and includes the second traction aid 122. The second base portion 104 further includes a second interior edge, the second base portion extending away from the second interior edge. The midsole traction device 100 includes a flexible connector portion 106 between the first interior edge of the first base portion 102 and the second interior edge of the second base portion 102. The flexible connection portion 106 hingedly connects the first base portion 102 to the second base portion 104. The flexible connector portion 106 forms an offset angle α which is acute between the first interior edge and the second interior edge.

What is claimed is:

1. A traction device for wearing about a footwear mid-sole, the traction device comprising:

a first base portion comprising a first traction aid on a first side of the first base portion;

a second base portion comprising a second traction aid of a first side of the second base portion, the second traction aid is different from the first traction aid; and a flexible connector portion hingedly connecting the first base portion to the second base portion, the flexible connector comprising a first edge extending between the first base portion and the second base portion and a second edge extending between the first base portion and the second base portion, wherein the first edge is shorter than the second edge, thereby creating an offset angle α between the first base portion and the second base portion, when the first base portion is in a position co-planar with the second base portion;

wherein the first base portion and the second base portion are configured for selective alternative engagement with the footwear mid-sole.

2. The traction device of claim 1, wherein the offset angle is approximately 15 degrees.

3. The traction device of claim 1, wherein the flexible connector portion is corrugated on a first side.

4. The traction device of claim 3, wherein the flexible connector portion is corrugated on a second side, the second side opposite the first side.

5. The traction device of claim 1, wherein the first traction aid comprises a plurality of cleats.

6. The traction device of claim 5, wherein the second traction aid comprises a plurality of cleats, the plurality of cleats in the second traction aid differing from the plurality of cleats in first traction aid by at least one of size, number of cleats, and configuration.

7. The traction device of claim 1, wherein the second traction aid comprises a plurality of grooves and channels in a predefined configuration.

8. The traction device of claim 1, further comprising a strap for securing the traction device to a wearer's footwear.

9. A traction device for wearing about a footwear mid-sole, the traction device comprising:

a first base portion having first side configured to face the footwear mid-sole and a second side opposite the first side and configured to face away from the footwear mid-sole, the first base portion comprising a first interior edge wherein the first base portion extends away from the first interior edge, and the first base portion comprises a first traction aid on the second side of the first base portion;

a second base portion having a first side configured to face the footwear mid-sole and a second side opposite the first side and configured to face away from the footwear mid-sole, the second base portion comprising a second interior edge wherein the first base portion extends away from the second interior edge, and the second base portion comprises a second traction aid on the second side of the second base portion, wherein the second traction aid is different from the first traction aid; and a flexible connector portion hingedly connecting the first interior edge of the first base portion to the second interior edge of the second base portion, wherein when the first base portion is co-planar with the second base portion, the flexible connector portion forms an acute angle between the first interior edge and the second interior edge.

10. The traction device of claim 9, wherein the first base portion and the second base portions are configured for selective alternative engagement with the footwear midsole.

11. The traction device of claim 9, wherein the acute angle is approximately 15 degrees.

12. The traction device of claim 9, wherein the flexible connector portion is corrugated on at least one side.

13. The traction device of claim 12, wherein the flexible connector portion comprises a first side configured to face the footwear mid-sole and a second side opposite the first side and configured to face away from the footwear mid-sole, wherein the first side of the flexible connector portion is corrugated.

14. The traction device of claim 9, wherein the first traction aid comprises a plurality of cleats.

15. The traction device of claim 9, wherein the second traction aid comprises a plurality of grooves and channels in a predefined configuration.

16. The traction device of claim 1, further comprising:

a first exterior edge of the first base portion opposite a first interior edge of the first base portion;

a second exterior edge of the second base portion opposite a second interior edge of the second base portion; and a strap extending from the first exterior edge to the second exterior edge and configured to retain the traction device about the footwear mid-sole.

* * * * *